US007536873B2

(12) United States Patent
Nohlen

(10) Patent No.: US 7,536,873 B2
(45) Date of Patent: May 26, 2009

(54) PROCESS AND DEVICE FOR COOLING A GAS BY DIRECT HEAT EXCHANGE WITH A COOLING LIQUID

(75) Inventor: Thomas Nohlen, Germering (DE)

(73) Assignee: Linde Aktiengesellschaft, Wiesbaden (DE)

( * ) Notice: Subject to any disclaimer, the term of this patent is extended or adjusted under 35 U.S.C. 154(b) by 379 days.

(21) Appl. No.: 11/350,882

(22) Filed: Feb. 10, 2006

(65) Prior Publication Data

US 2006/0179878 A1 Aug. 17, 2006

(30) Foreign Application Priority Data

Feb. 11, 2005 (EP) ..... 05002984

(51) Int. Cl.

| | |
|---|---|
| ***F25J 3/00*** | (2006.01) |
| ***F28C 1/00*** | (2006.01) |
| ***F28D 3/00*** | (2006.01) |
| ***F28D 5/00*** | (2006.01) |
| ***A61M 16/10*** | (2006.01) |
| ***F02M 15/00*** | (2006.01) |

(52) U.S. Cl. ..... 62/644; 62/171; 62/310; 62/121; 261/131; 261/150

(58) Field of Classification Search ..... 62/644, 62/310, 121, 171; 261/131, 150, 151
See application file for complete search history.

(56) References Cited

U.S. PATENT DOCUMENTS 3,731,488 A * 5/1973 Sasakura et al. ..... 60/645
4,474,027 A * 10/1984 Kaya et al. ..... 62/171
5,481,880 A * 1/1996 Guillard et al. ..... 62/644
7,225,637 B2 * 6/2007 Le Bot ..... 62/644
7,272,955 B2 * 9/2007 Fert ..... 62/648

FOREIGN PATENT DOCUMENTS

| | | |
|---|---|---|
| DE | 10115258 | 1/1993 |
| EP | 1284402 | 7/2002 |
| JP | 1067587 | 3/1989 |
| JP | 1107082 | 4/1989 |
| JP | 4251181 | 9/1992 |

OTHER PUBLICATIONS

Patent Abstracts of Japan, Bd. 017, Nr.027, Jan. 19, 1993.
Patent Abstracts of Japan, Bd. 2000, Nr. 18, Jun. 5, 2001.

* cited by examiner

*Primary Examiner*—William C Doerrler
(74) *Attorney, Agent, or Firm*—Millen, White, Zelano, Branigan, P.C.

(57) ABSTRACT

For cooling a gas by direct heat exchange with a cooling liquid, the gas (1) to be cooled is introduced into the lower region of a direct contact cooler (2). A first stream of cooling liquid (8) is fed into the direct contact cooler (2) above the point of introduction of the gas (1). Cooled gas (5) is removed above the point of introduction of the gas (1) from the direct contact cooler (2). A liquid backflow (10) is drawn off from the lower region of the direct contact cooler (2). At least at times, a second stream of cooling liquid (13) with a temperature that is lower than that of the backflow (10) is fed into the liquid backflow (10) and combined with the latter to form a return flow (11).

20 Claims, 1 Drawing Sheet

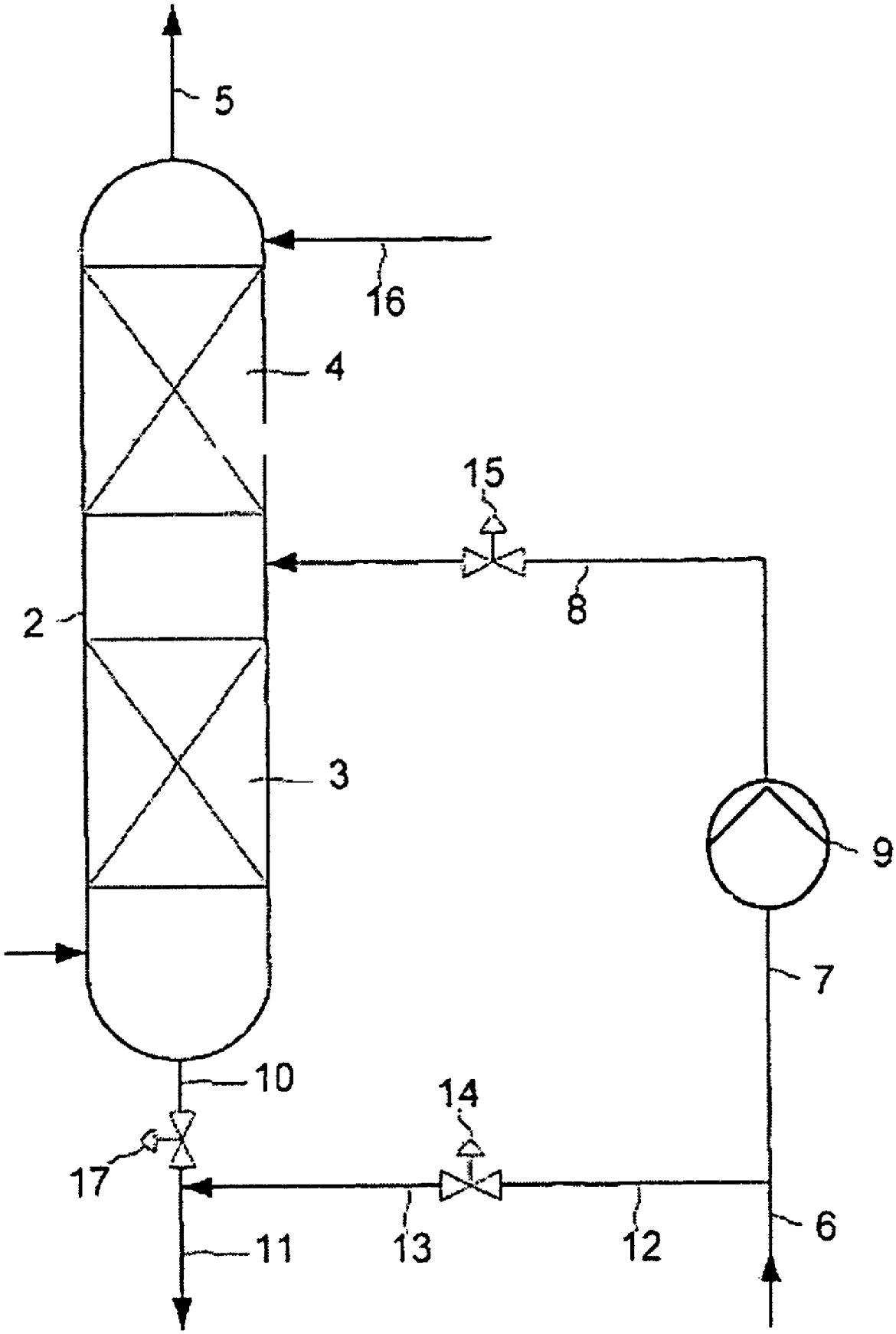
5
16
4
15
8
2
3
9
7
10
14
17
13
12
6
11

PROCESS AND DEVICE FOR COOLING A GAS BY DIRECT HEAT EXCHANGE WITH A COOLING LIQUID

The invention relates to a process for cooling a gas by direct heat exchange with a cooling liquid and a corresponding device. Here, a rising gas is brought into direct countercurrent contact with a first stream of cooling liquid in a direct contact cooler. Cooled gas and a liquid backflow are drawn off from the direct contact cooler and passed on as a return flow.

Such a process is used in, for example, the cooling of compressed air, especially for precooling air separation systems. This relates to both low-temperature processes and also to non-cryogenic separation processes, for example with adsorption or membrane technology. Processes and devices for low-temperature air separation are known from, for example, Hausen/Linde, Low-Temperature Technology, 2nd Edition 1985, Chapter 4 (pages 281 to 337). Examples of air separation systems with direct contact coolers are found in Wagner, "Air Separation Technology Today," 5th symposium to be arranged by LINDE AG in Munich, Jun. 25-27, 1986, Article A (FIG. 1a) and Wagner, Entwicklung der Luftzerlegertechnologie [Development of Air Separator Technology], Linde Symposium on Air Separation Systems 1980, Article A, (FIG. 11).

In the precooling of charging air for air separation, the air is cooled upstream from the main heat exchanger or a cleaning device, for example from 50 to 150° C. to 5 to 40° C., preferably from 90 to 100° C. to 8 to 12° C. Generally, the cooling liquid is cooling water that in many cases is routed in a cooling water circuit. Often, this cooling water circuit is incorporated into a larger cooling water system that also delivers cooling water for other processes. In such a cooling water system, the supply temperature and return temperature are stipulated, i.e., in the direct contact cooler, a certain temperature difference between the first stream of cooling liquid and the return flow must be achieved. In the past, this was done by corresponding dimensioning of the flow rate of the first stream of cooling liquid.

The object of the invention is to make such a process more economically advantageous.

This object is achieved in that the temperature of the return flow is controlled by a second stream of cooling liquid, whose temperature is lower than that of the backflow, being introduced into the liquid return flow. A portion of the available cooling liquid thus does not participate at all or at least not entirely in direct heat exchange with the gas that is to be cooled.

This is counterproductive at first glance, since the corresponding cooling capacity is apparently not used. Within the framework of the invention, however, it has been found that in conventional cooling processes of the initially mentioned type, often much larger amounts of cooling liquid are run over the direct contact cooler than is necessary with respect to the desired cooling of the gas. In the invention, it is now possible to set the amount of cooling liquid that has run over the direct contact cooler independently of the setpoint selections for the supply and return-temperature. Here, an elevated temperature in the backflow is produced from the direct contact cooler. The given return temperature is still reached by cold cooling liquid from the second stream of cooling liquid being mixed in.

In the process according to the invention, therefore, the liquid load of the direct contact cooler and optionally of upstream pressure-boosting pumps becomes correspondingly less. These components and the related lines can be made correspondingly smaller. At the same time, drive energy in the pumps can be saved. The mixing of hot and cold cooling liquid that is inherently unfavorable in terms of energy is by far overcompensated by these advantages.

For example, water can be used as the cooling liquid.

The direct contact cooler can be made basically as a spray zone cooler. Generally, however, it has components in the form of material exchange elements, especially grid trays, fillers, and/or ordered packing.

Preferably, an integrated cooling liquid system is used in the process, from which the first and the second streams of cooling liquid originate and to which the return flow is returned. In the cooling liquid system, the return flows of several consumers are combined, cooled in a liquid cooling device, for example in a cooling tower or an evaporative cooler, and then made available again to the consumers as supply. The first and generally also the second streams of cooling liquid originate from this cooling water system.

Basically, the second stream of cooling liquid can originate from any source for cooling liquid with a temperature that is correspondingly low, especially from the other consumers of the cooling liquid system, for example the intercoolers and/or aftercoolers of a gas compressor in which the gas to be cooled is compressed. In order to make the process in the direct contact cooler especially independent of the other stream of cooling liquid, it is advantageous, however, if a first stream of cooling liquid and a second stream of cooling liquid are branched off out of a main stream of cooling liquid, this main stream of cooling liquid in particular not supplying any other cooling liquid consumers.

Preferably, the temperature of the return flow is adjusted by setting the amounts of the first and second stream of cooling liquid. In this case, setting the amounts of the two streams of cooling liquid can be done by hand, by automatic control of the mixing temperature, or by fixed setting of a predetermined ratio or predetermined absolute amounts.

If the first stream of cooling liquid is routed separately from the second stream of cooling liquid through one or more cooling liquid pumps, the pumps and the lines connected to them can be dimensioned to be correspondingly small.

In addition, the invention relates to a device for cooling a gas as well as processes and devices for gas separation, especially low-temperature air separation.

A cooling system for conducting the invention comprises a direct contact cooler, means for feeding gas into the lower region of the direct contact cooler, conduit for feeding a first stream of cooling liquid into the direct contact cooler above the point of introduction of the gas, conduit for withdrawing cooled gas from the direct contact cooler above the point of introduction of the gas, and conduit for withdrawing a liquid backflow from the lower region of the direct contact cooler, characterized by conduits for admixing a second stream of cooling liquid with a temperature that is lower than that of a backflow, into the liquid backflow, by a return line for the mixture comprising the second stream of cooling liquid and the backflow, and optionally by a control device for controlling the temperature of the return flow by setting the amounts of the first and second streams of cooling liquid.

For low-temperature gas separation, especially air separation, the outlet gas from an intermediate or final stage of a compressor is fed into the cooling system of the invention.

The resultant cooled air is then fed into a conventional gas (air) separation plant, either directly or via a conventional cleaning device.

BRIEF DESCRIPTION OF DRAWING

FIG. 1 is a schematic flowsheet of an embodiment of the cooling system of the invention.

The invention as well as other details of the invention are explained in more detail below with reference to the embodiment of the drawing, it being understood that this description is not intended to limit the appended claims.

By way of line 1, gas is fed into the lower area of a direct contact cooler 2, in the example directly above the bottom. The direct contact cooler has two material exchange sections 3, 4 that are each equipped with grid or sieve trays, fillers or ordered packing. The liquid distributors above these sections are not shown. Gas that has been cooled by way of the line 5 emerges at the top of the direct contact cooler.

The gas 1 that is to be cooled preferably originates from a feed gas compressor (not shown) that under certain circumstances has an aftercooler in which some of the heat of compression is dissipated by means of indirect heat exchange; such an aftercooler is not provided in the depicted embodiment, however. Here, the gas 1 with a temperature from 90 to 100° C. enters the direct contact cooler 2, and the cooled gas 5 flows out again at 8 to 12° C.

By way of line 6, a main stream of cooling liquid from a cooling liquid system is delivered at a predetermined supply temperature of preferably 15 to 45° C., for example roughly 30° C. At least one part as the first stream of cooling liquid 7, 8 is delivered by means of a pump 9, for example electrically driven, to the lower section 3 of the direct contact cooler 2. This cooling liquid in the direct contact cooler 2, 3 enters into direct heat exchange with the gas from the line 1. It is heated in doing so and is drawn off as a backflow 10 from the direct contact cooler. The backflow flows back into the cooling liquid system by way of the return line 11.

According to the invention, it is mixed beforehand with a second stream of cooling liquid 12, 13 with a lower temperature. In the example, the second stream of cooling liquid is branched, for example, out of the main stream of cooling liquid 6. The return temperature in the line 11 (preferably 25 to 55° C., for example roughly 40° C.) is set by way of the amounts of flow of the first stream of cooling liquid (preferably 30 to 60° C., for example roughly 45° C.) and of the second stream of cooling liquid (preferably 15 to 45° C., for example roughly 30° C.) by the corresponding setting of the valves 15, 14. In this case, the amounts of the two streams of cooling liquid can be set by hand, by automatic temperature control or as a fixed setting of a predetermined ratio or of predetermined absolute amounts. Optionally, the drain valve 17 for the backflow 10 can be included in this control.

In this way, it is possible, regardless of the setpoint selections of the cooling liquid system, to feed into the direct contact cooler via the line 8 only the amount of cooling liquid that is in fact needed for gas cooling in the section 3. The return temperature stipulated by the cooling liquid system is reached independently thereof via admixture 13 into the backflow 10.

The upper section 4 of the direct contact cooler is not critical to the process according to the invention and can basically be omitted. In the embodiment, it is used for further cooling of the gas by means of a third stream of cooling liquid 16 that can be formed especially by fresh water or by cold water from an evaporative cooler or a refrigerating plant.

In the embodiment, the gas comprises atmospheric air. The cooled air 5 is treated in an adsorptive cleaning device and then enters into the coldbox of a low-temperature separating device. There, it is cooled roughly to the saturation temperature in a main heat exchanger and fed into the separating column or into one or more of the separating columns of the distillation column system of the separating device.

The cooling liquid comprises water.

In one specific application of the embodiment, the temperature of the backflow 10 compared to a process without admixture (valve 14 closed) was raised by 5 Kelvin degrees. It was possible to reduce the amount of the first stream of cooling liquid 7, 8 by roughly 40%. In this way, it is possible to reduce the size of the direct contact cooler in cross-section by roughly 10% and to save roughly 40% of the pump output in 9.

Alternatively to branching the second stream of cooling liquid 13 out of the cooling liquid supply, the backflow 10 can be mixed with another relatively cold stream of cooling liquid, for example with one or more backflows from the intercoolers of one or more gas compressors. In doing so, within the framework of the invention, a relatively high throughput of cooling liquid through the corresponding intercooler is set in order to achieve a correspondingly low temperature before mixing with the backflow from the direct contact cooler.

The entire disclosure[s] of all applications, patents and publications, cited herein and of corresponding European application No. 05002984.2, filed Feb. 11, 2005 incorporated by reference herein.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the scope thereof, can make various changes and modifications of the invention to adapt it to various usages and conditions.

The invention claim is:

1. A process for cooling a gas by direct heat exchange with a cooling liquid, said process comprising:

introducing gas (1) into the lower region of a direct contact cooler (2), introducing a first stream of cooling liquid (8) into the direct contact cooler (2) at a point above the point of introduction of said gas (1), removing cooled gas (5) from the direct contact cooler (2) at a point above the point of introduction of said gas (1), and drawing off a liquid backflow (10) from the lower region of the direct contact cooler (2), wherein the temperature of said liquid backflow is adjusted by introducing a second stream of cooling liquid (13), whose temperature is lower than that of said liquid backflow (10), into said liquid backflow at least for some period(s) of time, and wherein the first stream of cooling liquid (7, 8) and the second stream of cooling liquid (12, 13) are branched off from a main stream of cooling liquid (6), and the second stream of cooling liquid (12, 13) is routed past the direct contact cooler (2).

2. A process according to claim 1, wherein said liquid backflow is delivered as return flow (11) to an integrated cooling liquid system that supplies cold cooling liquid, and from which the first stream of cooling liquid is removed, and from which the second stream of cooling liquid is removed.

3. A process according to claim 1, wherein the temperature of said liquid backflow is adjusted by setting (14, 15) the amounts of the first and second streams of cooling liquid.

4. A process according to claim 1, wherein the first stream of cooling liquid (7, 8) is routed separately from the second stream of cooling liquid through one or more cooling liquid pumps (9).

5. A device for cooling a gas by direct heat exchange with a cooling liquid, said device comprising:

a direct contact cooler, conduit means for introducing gas into the lower region of the direct contact cooler, conduit means for introducing a first stream of cooling liquid into the direct contact cooler above the point of introduction of the gas, conduit means for withdrawing cooled gas from the direct contact cooler above the point of introduction of the gas, conduit means for withdrawing a liquid backflow from the lower region of the direct contact cooler, means for admixing a second stream of cooling liquid, whose temperature is lower than that of the backflow, into the liquid backflow, a return line for the mixture comprising the second stream of cooling liquid and the backflow, by a control device for controlling the temperature of the mixture by setting the amounts of the first and/or second stream(s) of cooling liquid, and means for branching said conduit means for introducing a first stream of cooling liquid and a conduit means for said second stream of cooling liquid from a main stream of cooling liquid, wherein said conduit means for said second stream of cooling liquid routs said second stream past said direct contact cooler.

6. A process for gas separation comprising: compressing a feed gas, cooling the compressed feed gas by the process according to claim 1, and supplying the cooled, compressed feed gas to a separating device.

7. A process for the low-temperature separation of air, comprising: compressing a feed air, cooling the compressed feed gas by the process according to claim 1, supplying the cooled, compressed feed gas to a cleaning device, and supplying the cleaned, cooled, compressed feed gas to a distillation column system with at least one separating column.

8. A device for gas separation comprising: a feed gas compressor, whose outlet is connected to a cooling device according to claim 5, and a separating device, whose inlet is connected to the outlet of said cooling device.

9. A device for low-temperature separation of air comprising a main air compressor having an outlet connected to a cooling device according to claim 5, and an air separating system having an inlet connected to the outlet means of said cooling device by way of a cleaning device.

10. A process according to claim 2, wherein the temperature of the return flow (11) is adjusted by setting (14, 15) the amounts of the first and second streams of cooling liquid.

11. A process according to claim 2, wherein the first stream of cooling liquid (7, 8) is routed separately from the second stream of cooling liquid through one or more cooling liquid pumps (9).

12. A process according to claim 4, wherein the first stream of cooling liquid (7, 8) is routed separately from the second stream of cooling liquid though one or more cooling liquid pumps (9).

13. A process according to claim 10, wherein the first stream of cooling liquid (7, 8) is routed separately from the second stream of cooling liquid through one or more cooling liquid pumps (9).

14. A process according to claim 1, wherein said direct contact cooler contains material exchange elements and said first stream of cooling liquid (8) is introduced into said direct contact cooler (2) at a point above said material exchange elements.

15. A device according to claim 5, wherein said control device includes a first valve for regulating the introduction of said first stream of cooling liquid into said direct contact cooler, and a second valve for regulating admixing of said second stream of cooling liquid into said liquid backflow.

16. A device according to claim 15, wherein said control device further includes a third valve for regulating the withdrawal of said liquid backflow from the lower region of the direct contact cooler.

17. A process according to claim 2, wherein said direct contact cooler contains material exchange elements and said first stream of cooling liquid (8) is introduced into said direct contact cooler (2) at a point above said material exchange elements.

18. A process according to claim 3, wherein said direct contact cooler contains material exchange elements and said first stream of cooling liquid (8) is introduced into said direct contact cooler (2) at a point above said material exchange elements.

19. A process according to claim 4, wherein said direct contact cooler contains material exchange elements and said first stream of cooling liquid (8) is introduced into said direct contact cooler (2) at a point above said material exchange elements.

20. A process according to claim 10, wherein said direct contact cooler contains material exchange elements and said first stream of cooling liquid (8) is introduced into said direct contact cooler (2) at a point above said material exchange elements.

* * * * *